US008860578B2

(12) United States Patent
Lynar et al.

(10) Patent No.: US 8,860,578 B2
(45) Date of Patent: Oct. 14, 2014

(54) RADIO-BASED HEAT AND FIRE DETECTION PELLETS

(75) Inventors: Timothy M. Lynar, Carlton Vic (AU); Kent C. Steer, Carlton Vic (AU)

(73) Assignee: International Business Machines Corporation, Armonk, NY (US)

( * ) Notice: Subject to any disclaimer, the term of this patent is extended or adjusted under 35 U.S.C. 154(b) by 273 days.

(21) Appl. No.: 13/329,495

(22) Filed: Dec. 19, 2011

(65) Prior Publication Data

US 2013/0154840 A1 Jun. 20, 2013

(51) Int. Cl.
*G08B 17/06* (2006.01)

(52) U.S. Cl.
USPC ..... 340/593; 340/539.26; 340/588

(58) Field of Classification Search
USPC ..... 340/539.26, 531, 588, 593, 628, 693.1, 340/693.6, 517, 584
See application file for complete search history.

(56) References Cited

U.S. PATENT DOCUMENTS

| | | | | |
|---|---|---|---|---|
| 4,292,617 | A * | 9/1981 | McVey | 337/407 |
| 4,363,031 | A * | 12/1982 | Reinowitz | 340/539.26 |
| 4,776,403 | A * | 10/1988 | Lejosne | 169/61 |
| 5,430,433 | A * | 7/1995 | Shima | 340/539.26 |
| 7,528,711 | B2 * | 5/2009 | Kates | 340/506 |
| 2010/0024518 | A1 * | 2/2010 | Radziszewski et al. | 73/7 |

* cited by examiner

*Primary Examiner* — Anh V La
(74) *Attorney, Agent, or Firm* — Tutunjian & Bitetto, P.C.; Vazken Alexanian

(57) ABSTRACT

A radio-based heat detection pellet is provided. The pellet includes a thermal switch configured to provide a detection signal when exposed to a temperature greater than a predetermined threshold temperature. The pellet further includes a transmitter circuit connected to the thermal switch and configured to transmit an alarm signal to a remote location in response to receiving the detection signal.

21 Claims, 5 Drawing Sheets

RADIO-BASED HEAT AND FIRE DETECTION PELLETS

BACKGROUND

1. Technical Field

The present invention relates generally to heat and fire detection and, in particular, to radio-based heat and fire detection pellets.

2. Description of the Related Art

When a fire starts in an unpopulated area, the time to detection is an important factor in the ability of emergency services to get control of the situation. When the fire reaches populated areas, the breadth of a fire-front is related to the resources required to prevent destruction to property, serious injury and loss of life. The destruction of large areas of bush land is also of concern. In some cases this may significantly disrupt the ecosystem and endanger the local wildlife. Early detection systems enable a fast response and thereby reduce the expected impact of a fire.

There are few known solutions to this problem, some of which utilize optical sensors, however optical solutions require line of sight, expensive cameras, and a constant source of power. Such existing products rely on tower-mounted high definition cameras and infrared sensors to detect fires. These systems have a number of drawbacks, which have prevented their widespread adoption. The main problem is cost. The construction of towers which provide vision over large unpopulated areas is expensive. The cameras and infrared sensors are also expensive. There is also the command center which must continually process the video footage to detect events of concern.

Another prior art approach involves a network of smoke detectors. However a smoke detector network would be expensive to set up and requires substantial maintenance.

SUMMARY

According to an aspect of the present principles, a radio-based heat detection pellet is provided. The pellet includes a thermal switch configured to provide a detection signal when exposed to a temperature greater than a predetermined threshold temperature. The pellet further includes a transmitter circuit connected to the thermal switch and configured to transmit an alarm signal to a remote location in response to receiving the detection signal.

According to another aspect of the present principles, a method is provided. The method includes providing a set of radio-based heat detection pellets. Each of the pellets in the set has a thermal switch and a transmitter circuit connected to the thermal switch. The method further includes configuring the thermal switch to provide a detection signal when exposed to a temperature greater than a predetermined threshold temperature. The method also includes configuring the transmitter circuit to transmit an alarm signal to a remote location in response to receiving the detection signal.

According to yet another aspect of the present principles, a system is provided. The system includes a plurality of radio-based heat detection pellets. Each of the pellets has a thermal switch configured to provide a detection signal when exposed to a temperature greater than a predetermined threshold temperature and has a transmitter circuit configured to transmit an alarm signal to a remote location in response to receiving the detection signal. The system further includes one or more monitoring stations. Each of the monitoring stations has a receiver for receiving the alarm signal from any of the plurality of radio-based heat detection pellets.

These and other features and advantages will become apparent from the following detailed description of illustrative embodiments thereof, which is to be read in connection with the accompanying drawings.

BRIEF DESCRIPTION OF DRAWINGS

The disclosure will provide details in the following description of preferred embodiments with reference to the following figures wherein.

DETAILED DESCRIPTION OF PREFERRED EMBODIMENTS

The present principles are directed to radio-based heat and fire detection pellets.

In an embodiment, an implementation of the present principles includes many pellets distributed over large areas of a target such as, for example, but not limited to, an unpopulated forest and bush land. When exposed to the heat of a fire, the pellet will send a radio signal indicating that it has been exposed to abnormally high temperatures, for example, above a given threshold temperature. The radio signal will allow the location of the sensor (pellet) to be detected, for example, through triangulation. The location can then be communicated to fire control. In an embodiment, the pellets could be designed in such a way so as not to use any energy until they are activated through high temperatures.

The pellets can be made small so as to have a minimal impact on the environment in which they will be deployed. These pellets can be made simple in design and thus cheap to mass produce. Hence, in an embodiment, the pellets are designed for single use.

In an embodiment, the distribution of pellets allows for the possible detection of the magnitude and direction of the fire. That is, the patterning of the pellets can be used to determine the magnitude of a fire as well as the direction in which the fire is currently moving.

In regard to receiving the signal sent by the pellets, in an embodiment, the position of the signal can be determined by a real-time location system (RTLS). Several such systems exist.

In an embodiment, the signal would be received by at least one radio signal receiver(s). The receiver would need to be connected to a computer which is either connected to a modem, a network, a cell phone, a satellite phone, or otherwise network connected. This connection would enable the received signal to be relayed to a control system. The control system would pool the received signals, determine location, and send an alert to the relevant authority, or any other parties as determined by the system manager/owner.

The determination of location where three or more receivers received the same signal can be accurately triangulated. Where fewer receivers received a signal, the determination of location of the signal would be less fine grained, but would be determined based on relative signal strength, and the location of the receiving signal detector.

Figure 1:
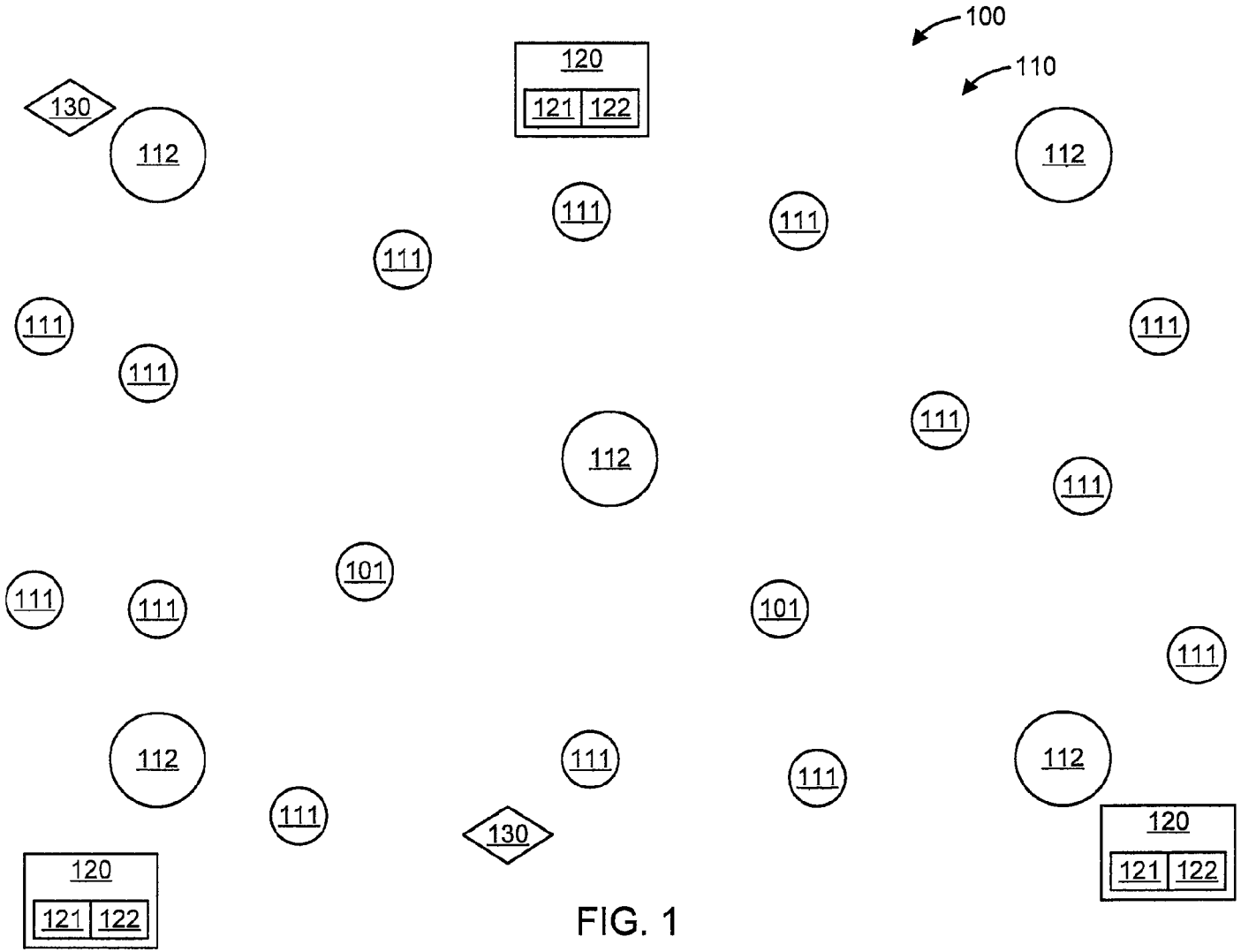
FIG. 1 shows an exemplary radio-based heat and fire detection system 100 using pellets, in accordance with an embodiment of the present principles.

FIG. 1 shows an exemplary radio-based heat and fire detection system 100 using pellets, in accordance with an embodiment of the present principles. The system 100 includes pellets 110 and monitoring stations 120.

The pellets 110 are preferably constructed to as to be able to withstand the elements (i.e., be capable of being located and operating in an outside environment). The pellets 110 can be arranged in predetermined patterns such that the current location of a heat source or fire as well as the direction in which the heat source or fire is moving can be determined based on the pellets that are currently transmitting. Moreover, the use of certain signal parameters and certain distribution parameters can enable the targeting of specific pellets as being the source of an alarm signal and hence the location of a heat source or fire.

In an embodiment, the pellets 110 include a set of short range pellets 111 and a set of long range pellets 112.

Regarding the short range pellets 111, in an embodiment, the same can be positioning around a monitoring station 120 within the maximum transmission distance. Any signal that is detected by a single monitoring station 120 can be inferred to have originated in the "near" vicinity of that station. Also, the strength of the signal can be used to further limit the possible points of origin.

Regarding the long range pellets 112, in an embodiment, the same can be positioned such that their signal can be detected by three (or more) monitoring stations 130 and, thus, their position can be determined through triangulation. The long range pellets 112 have a larger battery than the short range pellets 111 and, thus, can cover greater distances.

In other embodiments, the pellets 110 may be capable of determining their own location (e.g., using GPS technology, etc.), and thus may simply directly transmit their location so that the location of the pellet does not have to be determined by another entity such as, for example, the monitoring stations 120. In such an embodiment, signal amplifiers 130 and the like may be positioned in pre-determined locations in order to enable a signal to reach a far monitoring station.

Depending on the implementation, the pellets 110 may be dropped by a plane or other airborne vehicle. In such a way, monitoring of remote and hard to reach locations may be implemented by simply dropping the pellets 110 at such locations by air.

Each monitoring station 120 includes a receiver 121 for receiving signals transmitted from the pellets 110. The receiver 121 includes an antenna (not shown). Moreover, each monitoring station can include signal processing circuits 122. Such signal processing circuits 122 may include, for example, signal strength determination circuits, and so forth for assisting in determining the location of transmitting pellets. While shown separate from the receiver 121, in other embodiments, the signal processing circuits 122 can be part of the receiver 121.

Figure 2:
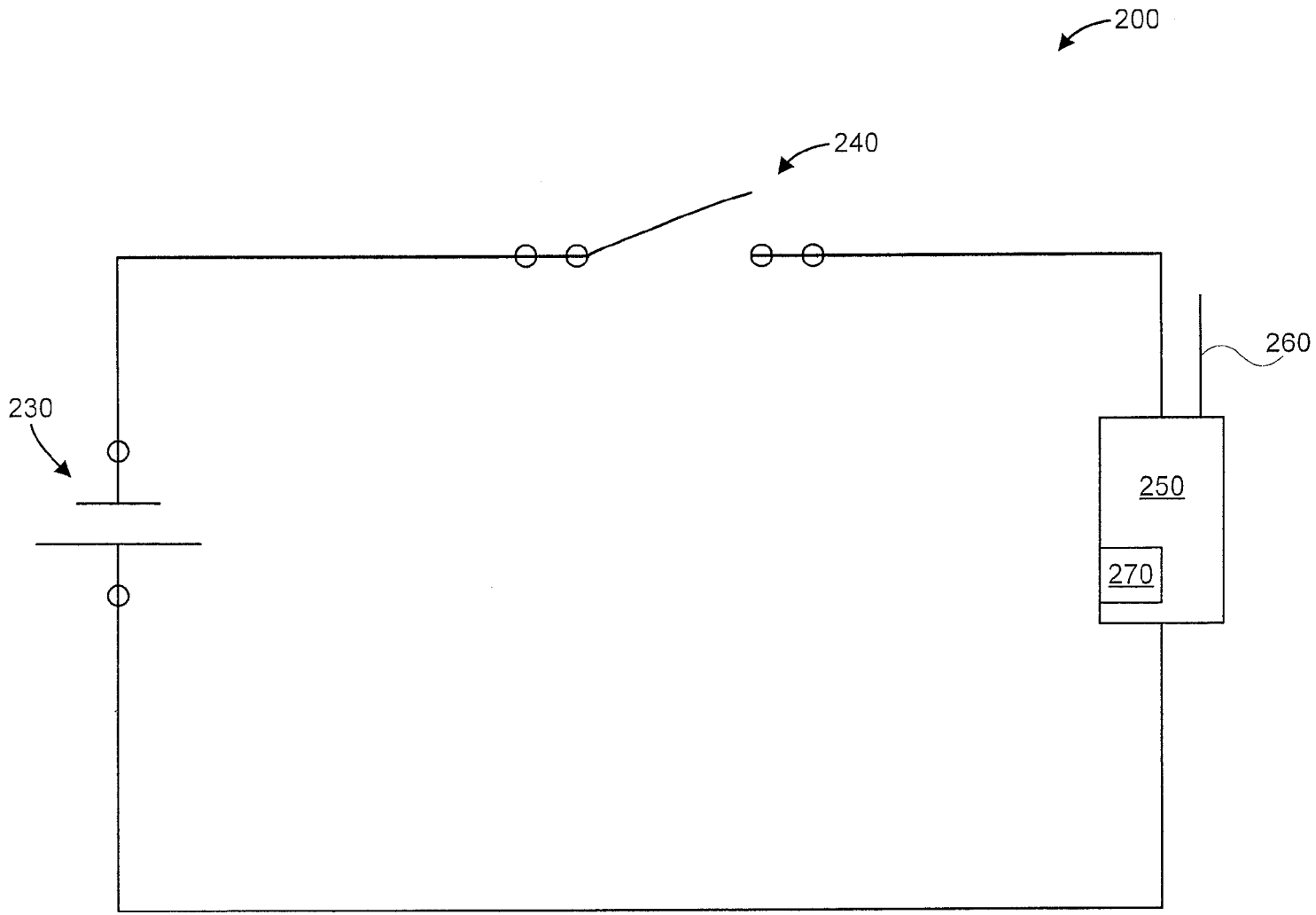
FIG. 2 shows an exemplary radio-based heat and fire detection pellet 110, in accordance with an embodiment of the present principles.

FIG. 2 shows an exemplary radio-based heat and fire detection pellet 110, in accordance with an embodiment of the present principles. The pellet 110 includes a battery 230, a thermal switch 240, a transmitter circuit (also interchangeably referred to herein as "control circuit") 250. The transmitter circuit 250 includes an antenna 260. The transmitter circuit 250 receives a signal (e.g., an open circuit indication) from the thermal switch 240 and in response thereto begins transmitting a signal.

In an embodiment, the signal can be common to all pellets 110. In another embodiment, the signal is slightly different between each of the pellets. For example, in an embodiment, the signal can include a particular identifier associated therewith and/or otherwise embedded therein in order to identify a particular pellet from among a lot of pellets or to identify information associated with a particular pellet. Such information can be distance information as described in further detail herein. In an embodiment, the identifiers can be aspects of the signal itself (e.g., different frequencies, amplitudes, wavelengths, embedded codes, and so forth for different identifiers).

In an embodiment, the transmitter circuit 250 may include a location determining circuit 270 that self-determines the location of the pellet. In an embodiment, such location determining circuit 270 uses the Global Positioning System (GPS).

Figure 3:
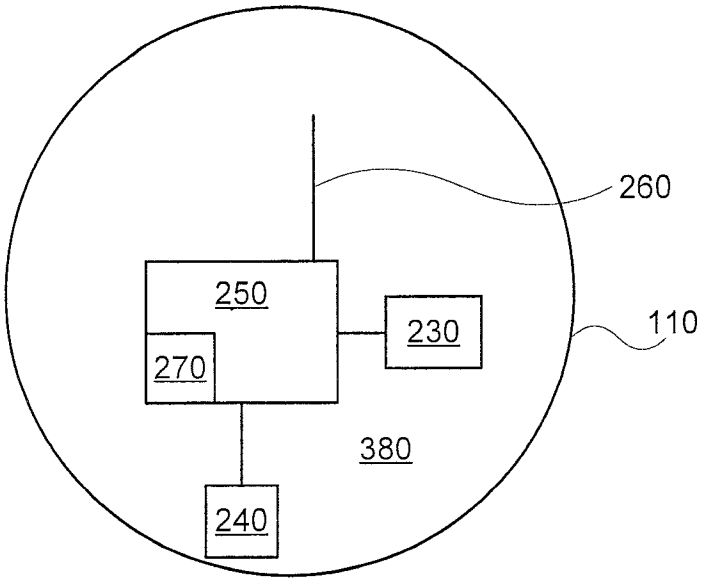
FIG. 3 further shows the exemplary radio-based heat and fire detection pellet 110, in accordance with an embodiment of the present principles.

FIG. 3 further shows the exemplary radio-based heat and fire detection pellet 110, in accordance with an embodiment of the present principles. As is evident, insulation 380 may be disposed within the pellet 110. The location and type of insulation 380 used may be determined in consideration of the placement of any other elements of the pellet 240 adjacent thereto and/or otherwise at least partially encapsulated thereby.

Figure 4:
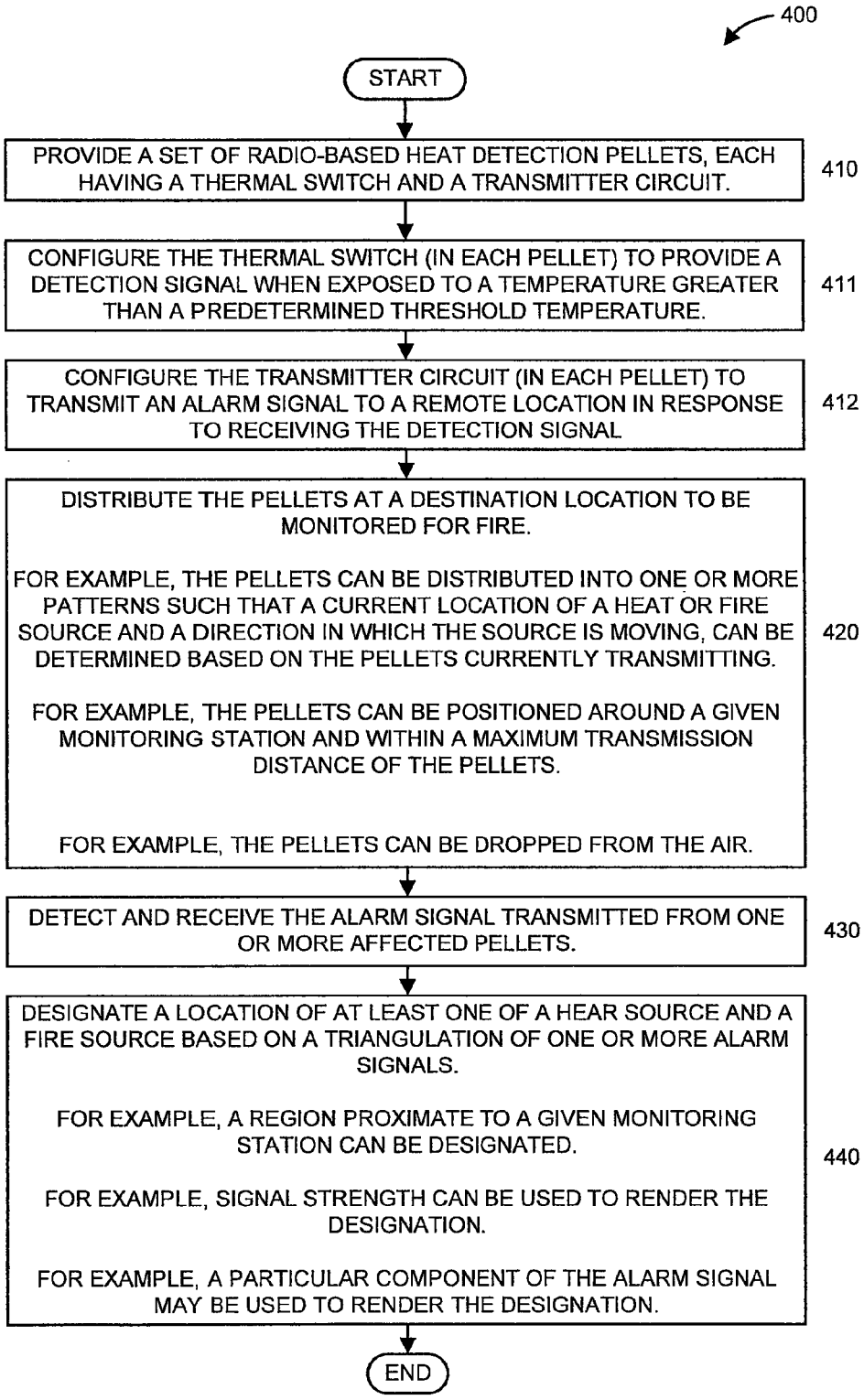
FIG. 4 shows an exemplary method 400 for using a radio-based heat and fire detection system 100, in accordance with an embodiment of the present principles.

FIG. 4 shows an exemplary method 400 for using a radio-based heat and fire detection system 100, in accordance with an embodiment of the present principles. At step 410, a set of radio-based heat detection pellets is provided. Each of the pellets has a thermal switch and a transmitter circuit connected to the thermal switch. At step 411, the thermal switch (in each pellet) is configured to provide a detection signal when exposed to a temperature greater than a predetermined threshold temperature. At step 412, the transmitter circuit (in each pellet) is configured to transmit an alarm signal to a remote location in response to receiving the detection signal.

At step 420, the pellets are distributed at a destination location to be monitored for fire. In an embodiment, step 420 can include, for example, positioning at least some of the pellets in the set into one or more predetermined patterns such that a current location of at least one of a heat source and a fire source, and a direction in which the at least one of the heat source and the fire source is moving, can be determined based the pellets that are currently transmitting. Moreover, in an embodiment, step 420 can include, for example, dropping one or more of the pellets into the destination location by an airborne vehicle. Further, in an embodiment, step 420 can include, positioning at least some of the pellets in the set around a given monitoring station and within a maximum transmission distance of the at least some of the pellets.

At step 430, the alarm signals transmitted from one or more affected pellets are detected and received. The alarm signals are transmitted from the one or more affected pellets when such pellets are "activated" due to their proximity to a heat source and transmit alarm signals. At step 440, a location of at least one of a heat source and a fire source (hereinafter "heat source") is designated based on a triangulation of one or more alarm signals. In an embodiment, step 440 can include designating a region proximate to a given monitoring station as the location of the heat source. Moreover, in an embodiment, step 440 can include determining a signal strength of at least some of the alarm signals transmitted proximate to a given monitoring station from the at least some of the pellets to further designate the location of the heat source. Further, in an embodiment, step 440 can include identifying a particular location as a location of at least one of a heat source and a fire source based a particular component (a frequency, an amplitude, a wavelength, an embedded code, and so forth) of the alarm signal transmitted by at least one of the pellets. For example, one variation of a component can be used, for example, to indicate certain pellets 100 yards from a monitoring station while another variation of the component can be used to indicate certain pellets 200 yards from a monitoring station. Other uses for such components can be readily determined by one of ordinary skill in the art, given the teachings of the present principles provided herein.

Figure 5:
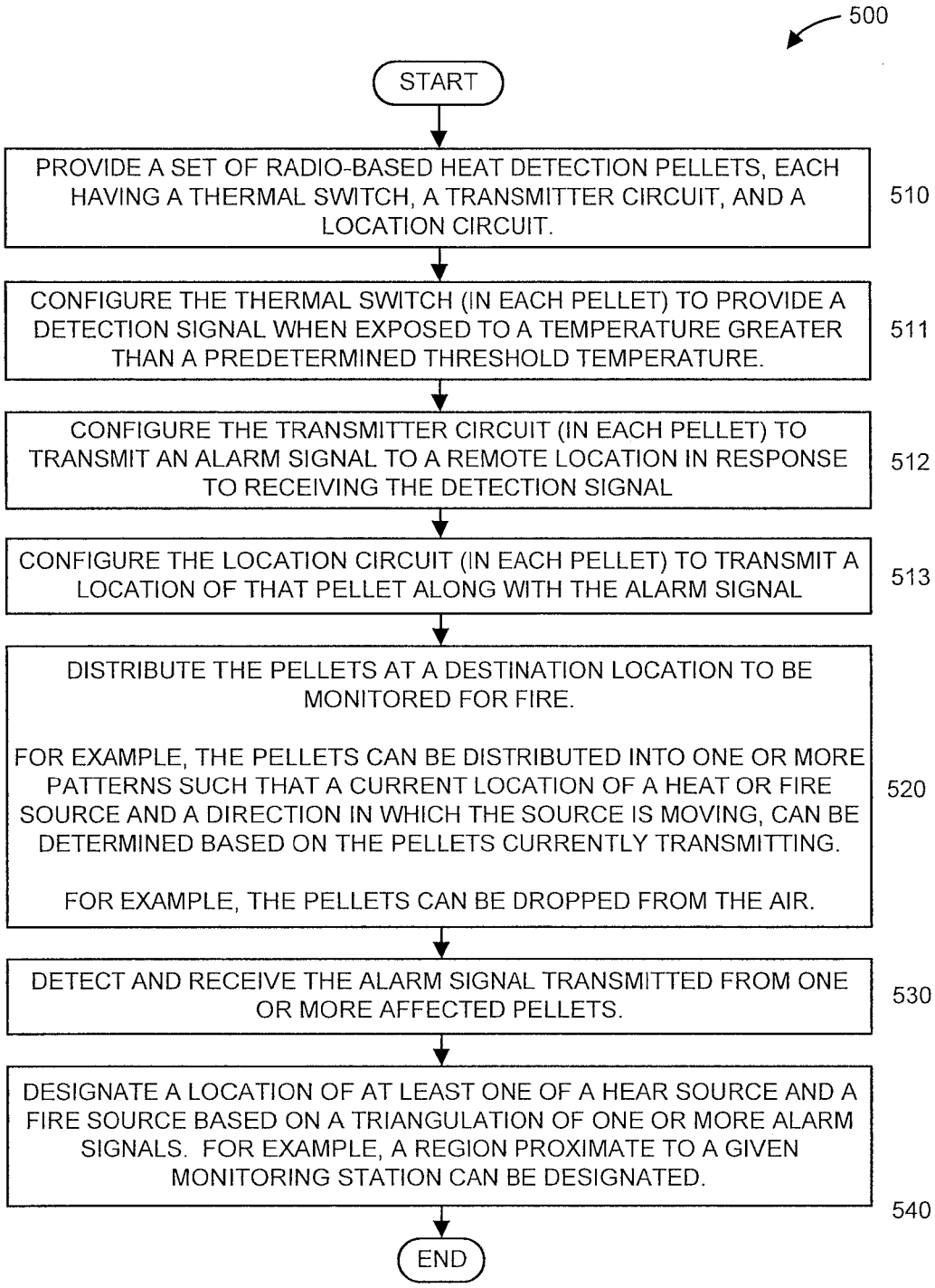
FIG. 5 shows another exemplary method 500 for using a radio-based heat and fire detection system 100, in accordance with an embodiment of the present principles.

FIG. 5 shows another exemplary method 500 for using a radio-based heat and fire detection system 100, in accordance with an embodiment of the present principles. At step 510, a set of radio-based heat detection pellets is provided. Each of the pellets has a thermal switch, a transmitter circuit connected to the thermal switch, and a location circuit connected to the transmitter circuit. At step 511, the thermal switch (in each pellet) is configured to provide a detection signal when exposed to a temperature greater than a predetermined threshold temperature. At step 512, the transmitter circuit (in each pellet) is configured to transmit an alarm signal to a remote location in response to receiving the detection signal. At step 513, the location circuit (in each pellet) is configured to transmit a location of that pellet along with an alarm signal to a remote location in response to receiving the detection signal.

At step 520, the pellets are distributed at a destination location to be monitored for fire. In an embodiment, step 520 can include, for example, positioning at least some of the pellets in the set into one or more predetermined patterns such that a current location of at least one of a heat source and a fire source, and a direction in which the at least one of the heat source and the fire source is moving, can be determined based on the at least some of the pellets that are currently transmitting. Moreover, in an embodiment, step 440 can include, for example, dropping one or more of the pellets into the destination location by an airborne vehicle.

At step 530, the alarm signals and locations transmitted from one or more affected pellets are detected and received. The alarm signals and locations are transmitted from the one or more affected pellets when such pellets are "activated" due to their proximity to a heat source and transmit alarm signals. At step 540, a location of at least one of a heat source and a fire source (hereinafter "heat source") is designated based on locations transmitted by the pellets. In an embodiment, step 540 can include designating a region proximate to a given monitoring station as the location of the heat source.

It is to be appreciated that while method 400 involves an embodiment in which the pellets are not provided with the capability to self-determine their own location, while method 500 involves an embodiment in which the pellets are provided with the capability to self-determine their location, such embodiments are not mutually exclusive and features of both may thus be combined in other embodiments of the present principles. That is, given the teachings of the present principles provided herein, one of ordinary skill in the art will contemplate these and other variations of the present principles, while maintaining the spirit of the present principles.

It is to be further appreciated that while the term "pellet" connotes a spherical shape, pellets according to the present principles can have any shape. In fact, in some embodiments, the implementation can be used to determine shape. For example, a non-spherical shape is preferred for hillsides to prevent rolling "out of position". In other cases, a spherical shape may be preferred. These and other variations are readily contemplated by one of ordinary skill in the art given the teachings of the present principles provided herein, while maintaining the spirit thereof.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Reference in the specification to "one embodiment" or "an embodiment" of the present principles, as well as other variations thereof, means that a particular feature, structure, characteristic, and so forth described in connection with the embodiment is included in at least one embodiment of the present principles. Thus, the appearances of the phrase "in one embodiment" or "in an embodiment", as well any other variations, appearing in various places throughout the specification are not necessarily all referring to the same embodiment.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

Having described preferred embodiments of a system and method (which are intended to be illustrative and not limiting), it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A radio-based heat detection pellet, comprising:

a thermal switch configured to provide a detection signal when exposed to a temperature greater than a predetermined threshold temperature; and a transmitter circuit connected to the thermal switch and configured to transmit an alarm signal to a remote location in response to receiving the detection signal, wherein the thermal switch is normally in an open circuit condition and switches to a closed circuit condition responsive to being exposed to the temperature greater than the predetermined threshold so as to operate in a digital manner of being in the open circuit condition or the closed circuit condition.

2. The radio-based heat detection pellet of claim 1, further comprising a location determining device for determining a current location of the pellet, and wherein said transmitter circuit is further configured to transmit the alarm signal along with the current location of the pellet.

3. The radio-based heat detection pellet of claim 2, wherein the location determining device comprises a global positioning system circuit for determining the current location of the pellet using a global positioning system.

4. A method, comprising:

providing a set of radio-based heat detection pellets, each having a thermal switch and a transmitter circuit connected to the thermal switch;

arranging at least some of the pellets in the set into one or more predetermined patterns such that a current location of at least one of a heat source and a fire source, and a direction in which the at least one of the heat source and the fire source is moving, can be determined based on the at least some of the pellets that are currently transmitting using respective location determination circuits in the at least some of the pellets that are currently transmitting;

configuring the thermal switch to provide a detection signal when exposed to a temperature greater than a predetermined threshold temperature; and configuring the transmitter circuit to transmit an alarm signal to a remote location in response to receiving the detection signal.

5. The method of claim 4, further comprising:

positioning at least some of the pellets in the set around a given monitoring station and within a maximum transmission distance of the at least some of the pellets;

detecting any alarm signals proximate to the given monitoring station transmitted from the at least some of the pellets; and designating a location of at least one of a heat source and a fire source as proximate to the given monitoring station based on the detected alarm signals.

6. The method of claim 5, further comprising using a signal strength of at least some of the alarm signals transmitted proximate to the given monitoring station from the at least some of the pellets to further designate the location of the at least one of the heat source and the fire source.

7. The method of claim 4, wherein the method further comprises:

positioning at least some of the pellets around a set of three or more monitoring stations; and designating a location of at least one of a heat source and a fire source based on at least a triangulation of one or more alarm signals.

8. The method of claim 4, wherein the thermal switch is normally in an open circuit condition and switches to a closed circuit condition responsive to being exposed to the temperature greater than the predetermined threshold so as to operate in a digital manner of being in the open circuit condition or the closed circuit condition.

9. The method of claim 4, further comprising dropping one or more of the pellets in the set into a destination location by an airborne vehicle.

10. The method of claim 4, further comprising identifying a particular location as a location of at least one of a heat source and a fire source based a particular component of the alarm signal transmitted by at least one of the pellets.

11. The method of claim 10, wherein the particular component is at least one of a frequency, an amplitude, a wavelength, and an embedded code.

12. The method of claim 10, further comprising varying the particular component relative to each of the pellets in the set so as to particularly identify any given one of the pellets relative to the other pellets.

13. The method of claim 7, wherein said designating step designates the location of the at least one of the heat source and the fire source based on a known maximum transmitting range of the pellets.

14. A system, comprising:

a plurality of radio-based heat detection pellets, each having a thermal switch configured to provide a detection signal when exposed to a temperature greater than a predetermined threshold temperature and having a transmitter circuit configured to transmit an alarm signal to a remote location in response to receiving the detection signal; and one or more monitoring stations, each having a receiver for receiving the alarm signal from any of the plurality of radio-based heat detection pellets, wherein at least some of the pellets in the set are arranged into one or more predetermined patterns such that a current location of at least one of a heat source and a fire source, and a direction in which the at least one of the heat source and the fire source is moving, can be determined based on the at least some of the pellets that are currently transmitting, and wherein at least one of the monitoring stations comprises signal processing circuitry configured to determine and use a signal strength of at least some of the alarm signals transmitted proximate to the at least one of the monitoring stations to further designate the location of the at least one of the heat source and the fire source.

15. The system of claim 14, further comprising one or more signal amplifiers disposed intermediately with respect to at least some of the pellets and at least some of the one or more monitoring stations to amplify an alarm signal.

16. The system of claim 14, wherein at least some of the plurality of radio-based heat detection pellets further comprise a location determining device for determining a current location of the pellet, and wherein the transmitter circuit therein is further configured to transmit the alarm signal along with the current location of the pellet.

17. The system of claim 16, wherein the location determining device comprises a global positioning system circuit for determining the current location of the pellet using a global positioning system.

18. The system of claim 14, wherein each of the plurality of radio-based heat detection pellets is configured to use a particular component of the alarm signal transmitted thereby as a particular identifier for that respective pellet.

19. The system of claim 18, wherein the particular component is at least one of a frequency, an amplitude, a wavelength, and an embedded code.

20. The system of claim 18, wherein the particular component is varied amongst the plurality of pellets so as to particularly identify any given one of the pellets relative to the other pellets.

21. The system of claim 14, further comprising a real-time locating system for determining respective locations of each of the plurality of pellets.

* * * * *